US007361840B2

(12) United States Patent
Kamata et al.

(10) Patent No.: US 7,361,840 B2
(45) Date of Patent: Apr. 22, 2008

(54) WIRE RECYCLING METHOD

(75) Inventors: Takeshi Kamata, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 194 days.

(21) Appl. No.: 10/490,391

(22) PCT Filed: Oct. 11, 2002

(86) PCT No.: PCT/JP02/10581

§ 371 (c)(1),
(2), (4) Date: Oct. 22, 2004

(87) PCT Pub. No.: WO03/034450

PCT Pub. Date: Apr. 24, 2003

(65) Prior Publication Data

US 2005/0052079 A1 Mar. 10, 2005

(30) Foreign Application Priority Data

Oct. 12, 2001 (JP) ..... 2001-316006

(51) Int. Cl.
*H01B 7/36* (2006.01)

(52) U.S. Cl. ..... 174/112; 174/102 R; 174/108; 385/109

(58) Field of Classification Search ..... 174/112, 174/135, 102 R, 108, 102 D, 109; 385/109
See application file for complete search history.

(56) References Cited

U.S. PATENT DOCUMENTS

| | | | | |
|---|---|---|---|---|
| 3,197,554 | A * | 7/1965 | Baker | 174/112 |
| 3,212,207 | A * | 10/1965 | Searing | 174/112 |
| 3,663,359 | A * | 5/1972 | Braim | 174/112 |
| 5,281,764 | A * | 1/1994 | King et al. | 174/112 |
| 5,286,922 | A * | 2/1994 | Curtiss | 174/112 |
| 5,401,908 | A * | 3/1995 | Rodeghero | 174/112 |
| 5,922,996 | A * | 7/1999 | Ryeczek | 174/112 |
| 6,498,300 | B2 * | 12/2002 | Flick | 174/110 R |
| 6,727,433 | B2 * | 4/2004 | Tsai | 174/112 |
| 6,825,418 | B1 * | 11/2004 | Dollins et al. | 174/112 |

FOREIGN PATENT DOCUMENTS

| | | | |
|---|---|---|---|
| EP | 0 520 680 | A2 | 12/1992 |
| JP | 58-643 | | 1/1983 |
| JP | 06-150730 | A * | 5/1994 |
| JP | 06-190315 | A * | 7/1994 |
| JP | 10-031918 | A * | 2/1998 |
| JP | 10-64345 | | 3/1998 |
| JP | 11-027817 | A * | 1/1999 |
| JP | 2003168329 | A * | 6/2003 |

* cited by examiner

*Primary Examiner*—Dhiru R. Patel
(74) *Attorney, Agent, or Firm*—Kratz, Quintos & Hanson, LLP

(57) ABSTRACT

The invention provides an electrical cable reuse method which reduces a long time stock of cables. For assembling a wiring harness, step S1 reuses special electrical cables stocked in an electrical cable storehouse, and the cables having been colored in a first color are coated with a second color. Step 2 cuts ordinary cables and special cables each in a desired length, removes a part of a cable sheath of each cable, and fits a terminal piece to the exposed part. Step 3 connects ordinary cables and the special cables with each other. Step 4 inserts the terminal piece into a connector housing.

5 Claims, 7 Drawing Sheets

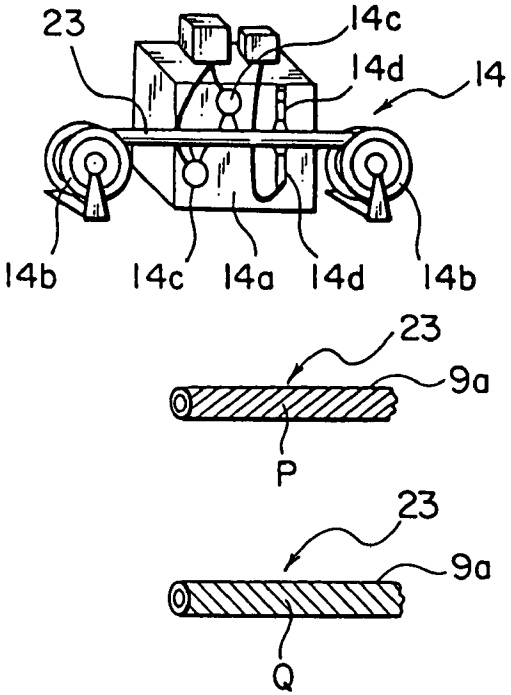
FIG. 3a
FIG. 3b
FIG. 3c
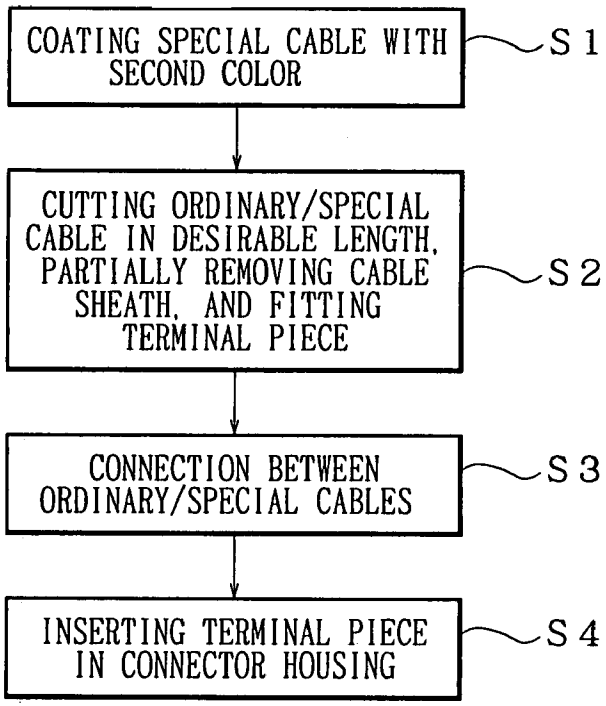
FIG. 2

WIRE RECYCLING METHOD

TECHNICAL FIELD OF THE INVENTION

The present invention relates to a method for assembling a wiring harness arranged in a motor vehicle which is a moving body.

BACKGROUND OF THE INVENTION

A motor vehicle, which is a moving body, has various kinds of electronic instruments mounted thereon. Thus, the vehicle is arranged with wiring harnesses for supplying an electrical power from an electrical source and for supplying control signals to such electronic instruments from a computer. The wiring harness has a plurality of electrical cables and connectors attached to terminals of the electrical cables.

The cable consists of electrical conductive core wires and an insulating sheath covering the wires. That is, the cable is a sheathed wire. The connector generally has a terminal piece and an insulating connector housing. The terminal piece is fitted to an end of the cable to electrically connect with the core wires. The connector housing has a box-like configuration for receiving the terminal piece.

The electrical cables of the wiring harness are selected as corresponding to the application, the size of the wire core, the material of the sheath, etc, the sheath material being determined to meet with, for example, a heat resistance performance. The application includes systems mounted on the vehicle like an air bag and an ABS (Antilock Brake System) which use electrical cables for transmitting control signals such as a vehicle speed and for supplying an electrical power.

Such electrical cables are colored or marked differently from each other to indicate the application of each cable. In a conventional wiring harness fabricating method, electrical cables are provided with colors or marks during an assembling step of wire cores that are made of an electrically conductive material such as copper.

The electrical cables provided with such colors are cut each in a desired length, and terminal pieces are fitted to ends of the cables. If required, the electrical cables are connected to each other. Then, the terminal pieces are received each in a connector housing to obtain a wiring harness.

Some electrical cables used for a particular application such as a ground circuit, a power circuit, and an air bag system of a particular car model have an outer surface provided with a color which is not selected frequently for wiring harnesses. This enables an easy recognition of the electrical cables for the particular application and eliminates a combination error of the cables to achieve a better available percentage of the cables used in the wiring harnesses.

However, after the production of the particular car model has come to an end, electrical cables having the rarely used color are used little or none of them are used.

Thus, the unused electrical cables having the rare color have to be stocked for a long time in a wiring harness assembling factory, increasing an inventory space thereof. Furthermore, the unused electrical cables have been thrown out after a predetermined stock period. This is not undesirable for saving natural resources.

In view of the foregoing situation, an object of the invention is an electrical cable reuse method which reduces a long time stock of cables.

SUMMARY OF THE INVENTION

For achieving the object, an electrical cable reuse method is applied to a wiring harness consisting of a plurality of electrical cables. The method is characterized in that a first electrical cable has a sheath of which an outer surface is provided with a first color, and the outer surface is covered by a coloring material having a second color different from the first color for assembling a wiring harness.

Thus, the sheath outer surface which has been coated with a first color is coated with a second color different from the first color, so that a special electrical cable is reused for a wiring harness. Preferably, the first color may be a rarely used color to recognize the special electrical cable which is rarely used. Preferably, the second color may be one which is frequently used.

Preferably, the special electrical cable is used for a special application such as a ground circuit, a power circuit, and an air bag system of a particular car model, and after the production of the particular car model has come to an end, the special electrical cables are used little or none of them are used. Since the application of the special electrical cables is limited, the first color of the special electrical cable may be preferably one rarely used. The special electrical cables tend to provide a stock thereof.

In this specification, a coloring material is used to color an outer surface of a cable sheath. The coloring material is a liquid-like material including a colorant (industrial organic material) dispersedly dissolved in a solvent such as water. The organic material is a dye or a pigment (mostly an organic, synthetic material). Some dyes are used as a pigment, or vice versa. In the specification, a coloring material means either of a dye and a pigment.

A coloring liquid means a solvent including dispersed or dissolved dyes, and a coating material means a dispersion including dispersed pigments. The dyes infiltrate into the outer surface of the cable sheath which is coated with the coloring liquid, while the pigments do not infiltrate into the outer surface of the cable sheath which is coated with the coating material. In the specification, the coloring of the outer surface of the cable sheath means that the whole or a part of the outer surface is colored by a dye or a pigment.

Preferably, the solvent or dispersion may be affinitive with a synthetic resin constituting the cable sheath, so that the dyes surely infiltrate into the cable sheath or the pigments surely adhere on the outer surface of the cable sheath.

An electrical cable reuse method according to the invention is characterized in that the first color is higher than the second color in a brightness scale.

That is, the first color is brighter than the second color, so that the second color can surely cover the first color.

An electrical cable reuse method is characterized in that the first color is not less than 6 and not more than 10 in the brightness scale.

Thus, the first color not less than 6 and not more than 10 in the brightness scale can surely cover the first color so that the second color is surely coated on the outer surface which has been coated with the first color.

An electrical cable reuse method is characterized in that the first color is not less than 7 and not more than 10 in the brightness scale.

Thus, the first color not less than 7 and not more than 10 in the brightness scale can surely cover the first color so that the second color surely coats the outer surface which has been coated with the first color.

An electrical cable reuse method is characterized in that the first color is not less than 7.5 and not more than 10 in the brightness scale.

Thus, the first color not less than 7.5 and not more than 10 in the brightness scale can surely cover the first color so that the second color surely coats the outer surface which has been coated with the first color.

An electrical cable reuse method is characterized in that the first color is not less than 8.5 and not more than 10 in the brightness scale.

Thus, the first color not less than 8.5 and not more than 10 in the brightness scale can surely cover the first color so that the second color surely coats the outer surface which has been coated with the first color.

An electrical cable reuse method is characterized in that the first color is the same as the second color in hue.

Thus, since the first color is the same as the second color in hue, the second color surely coats the outer surface which has been coated with the first color.

In the invention, it is preferable that dyes included in a coloring liquid coats the outer surface of the cable sheath. The hue means a color tone such as red, yellow, green, blue, etc., which is defined by JIS (Japanese Industrial Standard) Z8721 and Z8105 or is defined by Munsell color system. The brightness is a color system, which is defined by JIS-Z8721 and Z-8105 or is defined by Munsell color system.

The brightness grades 6, 7, 7.5, 8.5, and 10 are values which are defined by JIS-Z8721 or Munsell color system.

BRIEF DESCRIPTION OF THE DRAWINGS

FIG. 2 is a flowchart showing sequential steps for producing a wiring harness by the wiring harness fabricating apparatus of FIG. 1;

FIG. 3 is an explanatory illustration showing a first coloring unit of the wiring harness fabricating apparatus of FIG. 1, FIG. 3*a* being an explanatory illustration showing the first coloring unit, FIG. 3*b* being a perspective view showing an electrical cable before the cable is colored by the first coloring unit, FIG. 3*c* being a perspective view showing an electrical cable after the cable is colored by the first coloring unit;

BEST MODE EMBODYING THE INVENTION

Referring to FIGS. 1 to 11, an electrical cable reuse method of an embodiment according to the present invention will be discussed hereinafter. For carrying out an electrical cable reuse method of an embodiment according to the present invention, a wiring harness fabricating apparatus 1 (shown in FIG. 1) is provided to assemble a wiring harness 2 shown in FIG. 11.

Figure 11:
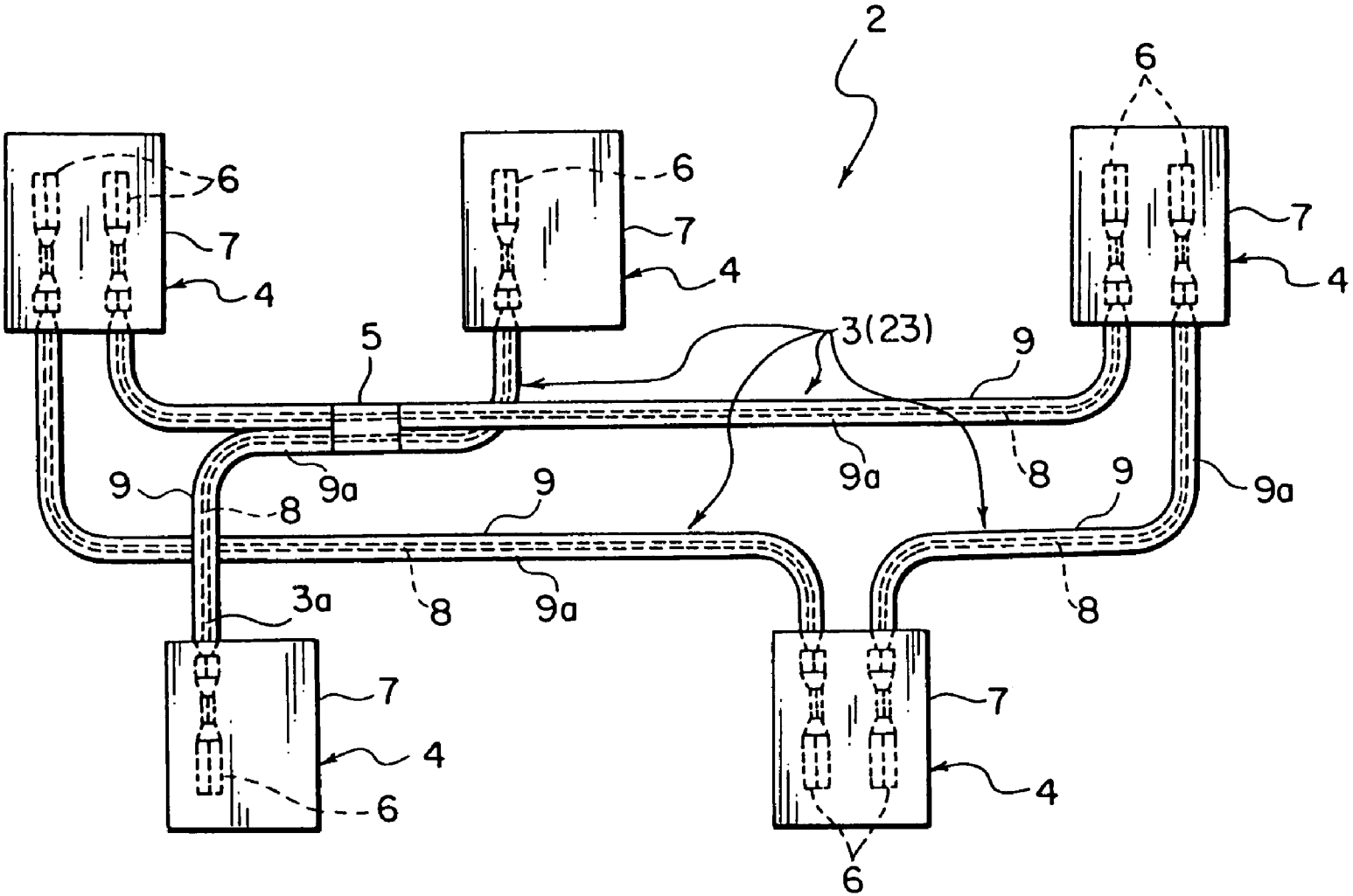
FIG. 11 is an explanatory illustration showing a general configuration of a wiring harness fabricated by the wiring harness fabricating apparatus of FIG. 1.

The wiring harness 2 is arranged generally in a car. As illustrated in FIG. 11, the wiring harness 2 has a plurality of electrical cables 3, a plurality of connectors 4, and jointing terminals 5. The cable 3 is called as an insulated cable consisting of an electrically conductive wire core 8 and a sheath 9 covering the wire core 8. The sheath 9 is made of an insulating synthetic resin material. The plurality of electrical cables 3 are made up in a bundle. The sheath 9 of each cable 3 has an outer surface 9*a* colored with a desired color Q, R, or S (shown by parallel diagonal lines in FIGS. 3 to 9).

The colors Q, R, and S are called as a second color hereinafter. The second colors Q, R, and S are ones frequently used for electrical cables 3 constituting the wiring harness 2. During a step for covering the wire core 8 by the sheath 9, a known colorant is mixed in a synthetic resin material constituting the sheath 9 so that the sheath 9 is colored in a desired second color Q, R, or S. Alternatively, no colorant is mixed in the synthetic resin material, while an outer surface 9*a* of the sheath 9 may be colored after molding of the sheath 9. The second colors Q, R, and S may be ones not frequently used.

The wiring harness 2 may also include a special cable 23 (for example, shown in FIG. 11) as an electrical cable 3. Since the special cable 23 has the same configuration as the electrical cable 3, the same reference numerals are provided for the same components so that the constitution of the special cable 23 is not discussed again. The special electrical cable 23 is used for a special application such as a ground circuit, a power circuit, and an air bag system of a particular car model, and after the production of the particular car model has come to an end, the special electrical cables 23 are used little or none of them are used. Since the application of the special electrical cable 23 is limited, the special electrical cables 23 tend to provide a stock thereof.

The sheath 9 of each special electrical cable 23 has an outer surface 9*a* colored with one of the colors Q, R, or S after the outer surface 9*a* is colored with a first color P (shown by parallel diagonal lines in FIGS. 3 to 9) which is rarely used. Like the 3, during a step for covering the wire core 8 by the sheath 9, a pigment is mixed in a synthetic resin material constituting the sheath 9 so that the sheath 9 is colored in a desired first color P. Alternatively, no colorant is mixed in the synthetic resin material, and an outer surface 9*a* of the sheath 9 of the special cable 23 may be colored in the first color after molding of the sheath 9. Thereafter, the outer surface 9*a* of the special cable 23 may be colored with one of the second colors Q, R, and S.

The first color P is, not less than 6 and not more than 10 in a brightness scale. The first color P is brighter than the second colors Q, R, and S. That is, the first color P is higher than the second colors Q, R, and S in a brightness scale. The first color P is rarely used for the electrical cables 3. The first color P may not be a rarely used color. Furthermore, the first color P is different from the second colors Q, R, and S. Preferably, the first color P is the same as the second colors Q, R, and S in hue.

The hue means a color tone such as red, yellow, green, blue, etc., which is defined by JIS (Japanese Industrial Standard) Z8721 and Z8105 or is defined by Munsell color system. The brightness is a color system, which is defined by JIS-Z8721 and Z8105 or is defined by Munsell color system.

The brightness grades 6, 7, 7.5, 8.5, and 10 described later are values which are defined by JIS-Z8721 or Munsell color system.

A higher grade shows a brighter color (or a more transparent color), and a lower grade shows a darker color (or a deeper color).

A connector 4 has an electrically conductive terminal piece 6 and an insulating connector housing 7. The terminal piece 6 is formed by bending an electrically conductive plate. The terminal piece 6 is fitted to an end of the cable 3 or 23 to be electrically connected to the wire core 8 of the cable 3 or 23. The connector housing 7 has a box-like shape to receive the terminal piece 6 which is secured in the connector housing 7.

A jointing piece 5 is formed from an electrically conductive plate. The sheath 9 of the cable 3 or 23 is removed so that the wire core 8 is exposed where the jointing piece 5 joins the wire cores 8 of the cables 3 or 23. The jointing piece 5 covers and crimps the exposed wire cores 8 to electrically connect the cables 3 or 23.

In the wiring harness 2 having the aforementioned configuration, the outer surface 9*a* of the sheath 9 of the special cable 23 which has been colored in the first color P is colored with one of the second colors Q, R, and S. Then, the cables 3 and 23 are cut in a desired length and the sheath 9 of each of the cables is partially removed at a one end thereof. The exposed portion of the wire core 8 is crimped by a terminal piece 6 so that the terminal piece 6 is fitted with the cable 3 or 23 at the one end thereof. The sheath 9 of each of the cables cable 3 or 23 is partially removed at a joint portion thereof. The exposed portion of the wire core 8 is crimped by a jointing piece 5 at the jointing portion so that the associated cables 3 or 23 are connected with each other. The terminal piece 6 is inserted into the connector housing 7 so that the terminal piece 6 is secured to the connector housing 7.

As mentioned above, the wiring harness fabricating apparatus 1 assembles the wiring harness 2 having the aforementioned configuration. The connector 4 is engaged with an associated connector of an electronic instrument mounted on a vehicle so that the assembled wiring harness 2 electrically connects a plurality of the electronic instruments each other. The wiring harness 2 transmits an electrical power and control signals between the electronic instruments.

Figure 1:
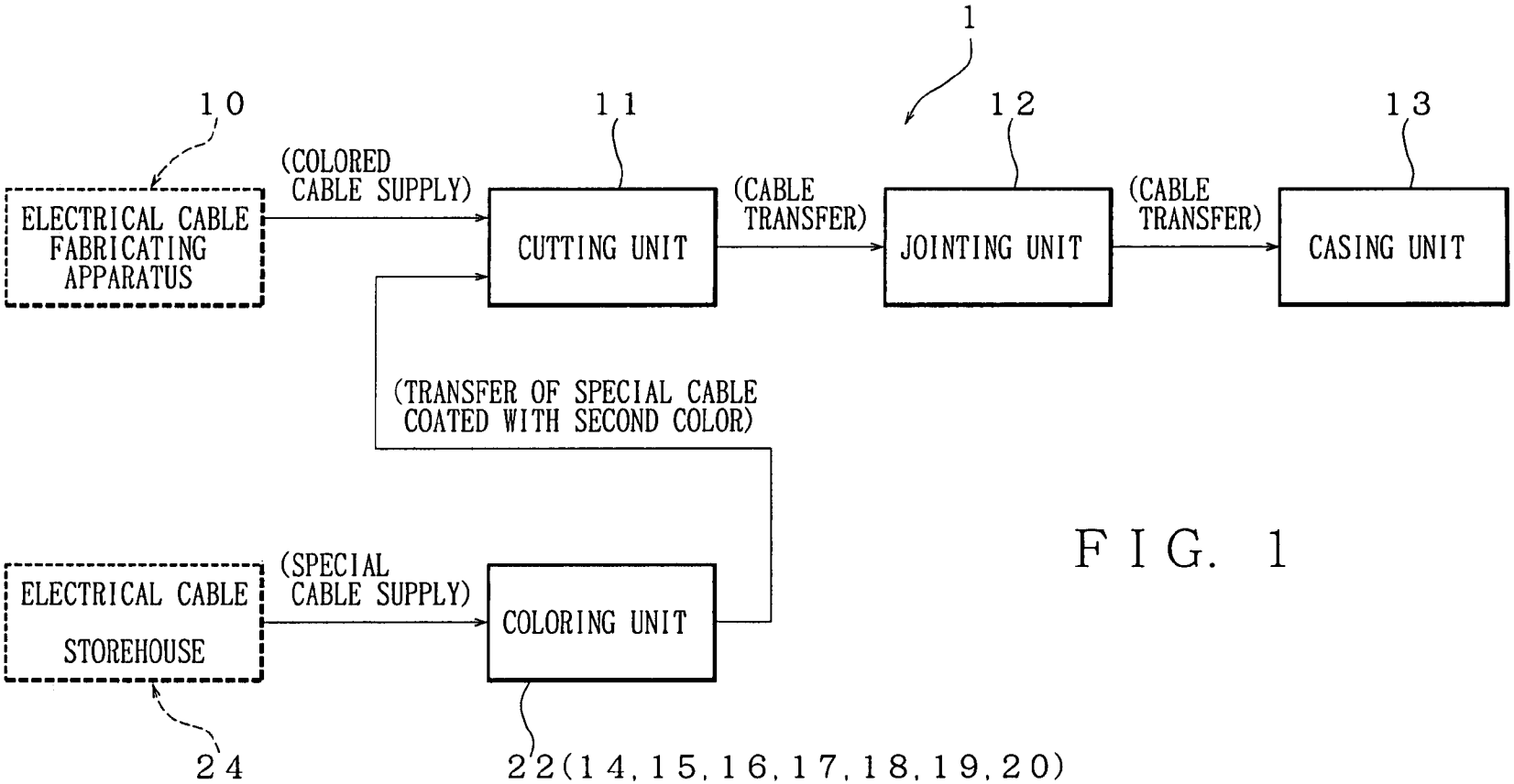
FIG. 1 is an explanatory illustration showing a configuration of a wiring harness fabricating apparatus for carrying out an electrical cable reuse method of an embodiment according to the present invention.

The wiring harness fabricating apparatus 1 assembles the wiring harness 2 configured as mentioned above. As shown in FIG. 1, the wiring harness fabricating apparatus 1 has a cutting unit 11, a jointing unit 12, a casing unit 13, and a coloring unit 22.

For the cutting unit 11, a cable 3 which is wound on a drum is supplied from the electrical cable fabricating apparatus 10. The electrical cable fabricating apparatus 10 forms the wire core 8 from an electrically conductive metal such as copper and covers the wire core 8 with an insulating synthetic resin material including a desired colorant to produce the cable 3. The sheath 9 of the cable 3 supplied from the electrical cable fabricating apparatus 10 to the cutting unit 11 has been colored in one of the second colors Q, R, and S by the colorant. That is, the cutting unit 11 is supplied with the cable 3 which has been colored already.

The cutting unit 11 is also supplied with the special cable 23 which has been colored with one of the second colors Q, R, and S by the coloring unit 22 to be changed from the first color P. In this specification, a coloring material is used to color the outer surface outer surface 9*a* of the cable sheath 9. The coloring material is a liquid-like material including a colorant (industrial organic material) dispersively dissolved in a solvent such as water. The organic material (mostly organic and synthetic material) is a dye or a pigment. Some dyes are used as a pigment, or vice versa. In the specification, a coloring material means either of a dye and a pigment.

A coloring liquid means a solvent including dispersed or dissolved dyes, and a coating material means a dispersion including dispersed pigments. Thus, the dyes infiltrate into the outer surface 9*a* of the cable sheath 9 which is coated with the colored liquid, while the pigments do not infiltrate into the outer surface 9*a* of the cable sheath 9 which is coated with the coating material. In the specification, the coloring of the outer surface of the cable sheath means that the whole or a part of the outer surface 9*a* is colored by a dye or a pigment.

Preferably, the solvent or dispersion may be affinitive with the synthetic resin constituting the cable sheath 9, so that dyes surely infiltrate into the cable sheath 9 or pigments surely adhere on the outer surface 9*a* of the cable sheath 9.

The cutting unit 11 cuts the cables 3 and 23 each in a desired length and removes the sheath 9 of the cut cable 3 or 23 at an end of each cable. The cutting unit 11 fits a terminal piece 6 to the exposed end of the cable 3 or 23.

The jointing unit 12 receives the cables 3 and 23 which have been fitted with the terminal pieces 6 in the cutting unit 11. The jointing unit 12 removes the sheath 9 at the jointing portion of the cable 3 or 23. The jointing unit 12 crimps the wire core 8 with a jointing piece 5 so that the cables 3 and 23 are connected with each other.

The casing unit 13 receives the cable 3 and 23, which have been fitted with the terminal pieces 6, from the jointing unit 12. The casing unit 13 inserts the terminal piece 6, which have been fitted at one end of the cable 3 or 23, into a connector housing 7. The casing unit 13 secures the terminal piece 6 to the connector housing 7 to assemble the connector 4.

The coloring unit 22 receives special cables 23, which are rarely used and tend to be a stock, from an electrical cable storehouse 24. The electrical cable storehouse 24 stores the special cables 23 which are used in a special car model but rarely used again. The electrical cable storehouse 24 may also store the cable 3.

The coloring unit 22 coats the outer surface 9*a* of the sheath 9 of the special cable 23 with a paint or dyes the outer surface 9*a* with a coloring liquid, so that the outer surface 9*a* of the sheath 9 is colored with one of the frequently used colors Q, R, and S different from the first color P. When the outer surface 9*a* of the sheath 9 is colored with dyes of a coloring liquid, the first color P is preferably the same as the second colors Q, R, and S in hue, and the first color P is higher than the second colors Q, R, and S in the brightness scale. The second colors Q, R, and S are frequently used for the cables 3 and 23 which constitutes the wiring harness 2.

In this embodiment, the first color P is the same as the second colors Q, R, and S in hue and is higher than the second colors Q, R, and S in the brightness scale. The coloring unit 22 consists of at least one of first to seventh coloring units 14 to 20 shown in FIGS. 3 to 9. That is, the wiring harness fabricating apparatus 1 has at least one of the first to seventh coloring units 14 to 20.

The first coloring unit 14 of FIG. 3 has a unit body 14*a*, a pair of rollers 14*b*, a plurality of sprayers 14*c*, and a dryer 14*d* as shown in FIG. 3*a*. The pair of rollers 14*b* are spaced from each other, between which the special cable 23 runs in a longitudinal direction of the special cable 23.

There are provided a pair of the sprayers 14*c* in an example shown in FIG. 3. The sprayer, 14*c* sprays a paint or a coloring liquid against the special cable 23 which is running between the pair of rollers 14*b*. The pair of sprayers 14*c* can color the perimeter of the outer surface 9*a* of the special cable 23 with the second color Q different from the first color P.

The dryer 14*d* is positioned downstream from the sprayers 14*c* in a running direction of the special cable 23. The dryer 14*d* dries up a paint or a coloring liquid which has been sprayed on the outer surface 9*a* of the special cable 23 by the sprayers 14*c*. Thus configured coloring unit 14 can coat the perimeter of the outer surface 9*a* of the special cable 23, which has been colored in the first color P (shown by parallel diagonal lines in FIG. 3*b*), with the second color Q (shown by parallel diagonal lines in FIG. 3*c*).

Figure 4A:
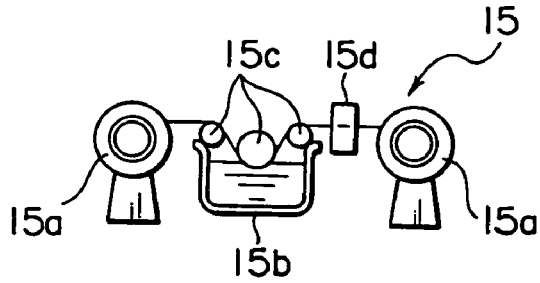
FIG. 4 is an explanatory illustration showing a second coloring unit of the wiring harness fabricating apparatus of FIG. 1, FIG. 4*a* being an explanatory illustration showing the second coloring unit, FIG. 4*b* being a perspective view showing an electrical cable before the cable is colored by the second coloring unit, FIG. 4*c* being a perspective view showing an electrical cable after the cable is colored by the second coloring unit.
Figure 4B:
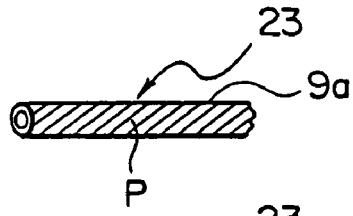

The second coloring units 15 of FIG. 4 has a pair of rollers 15*a*, a dipping bath 15*b*, a plurality of guide rollers 15*c*, and a squeegee 15*d* as shown in FIG. 4*a*. The pair of rollers 15*a* are spaced from each other, between which the special cable 23 runs in a longitudinal direction of the special cable 23.

The dipping bath 15*b* is positioned between the pair of rollers 15*a* and is a box opened upward. The dipping bath 15*b* contains a coloring liquid or a paint which has a second color Q different from a first color P. The plurality of guide rollers 15*c* are positioned between the pair of rollers 15*a* to be spaced apart from each other along a running direction of the special cable 23. The guide rollers 15*c* serves to dip the special cable 23 running between the pair of the rollers 15*a* in the coloring liquid or paint in the dipping bath 15*b*.

The squeegee 15*d* is positioned between the dipping bath 15*b* and a downstream one of the rollers 15*a* in a running direction of the special cable 23. The squeegee 15*d* removes a surplus paint or coloring liquid which has been adhered on the outer surface 9*a* of the special cable 23.

Figure 4C:
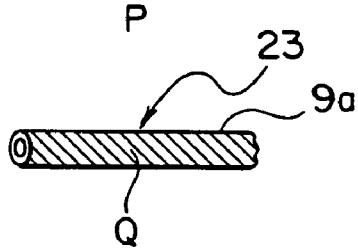

Thus configured second coloring units 15 can dip the perimeter of the outer surface 9*a* of the special cable 23, which has been colored in a first color P (shown by parallel diagonal lines in FIG. 4*b*), in the dipping bath 15*b* so that the outer surface 9*a* is colored with a second color Q (shown by parallel diagonal lines in FIG. 4*c*).

Figure 5A:
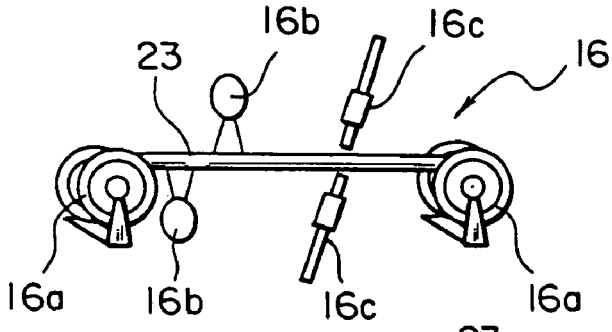
FIG. 5 is an explanatory illustration showing a third coloring unit of the wiring harness fabricating apparatus of FIG. 1, FIG. 5*a* being an explanatory illustration showing the third coloring unit, FIG. 5*b* being a perspective view showing an electrical cable before the cable is colored by the third coloring unit, FIG. 5*c* being a perspective view showing an electrical cable after the cable is colored by the third coloring unit.
Figure 5B:
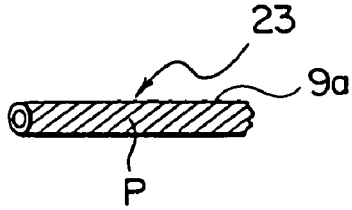
Figure 5C:
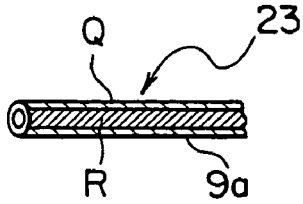

The third coloring unit 16 of FIG. 5 has a pair of rollers 16*a*, a plurality of sprayers 16*b*, and a plurality of marking dies 16*c* as shown in FIG. 5*a*. The pair of rollers 16*a* are spaced from each other, between which the special cable 23 runs in a longitudinal direction of the special cable 23.

There are provided a pair of the sprayers 16*b* in an example shown in FIG. 5. The sprayers 16*b* sprays a paint or a coloring liquid against the special cable 23 which is running between the pair of rollers 16*a*. The pair of sprayers 16*b* can color the perimeter of the outer surface 9*a* of the special cable 23 with a second color Q different from a first color P.

There are provided a pair of the marking dies 16*c* in an example shown in FIG. 5. The marking dies 16*c* are positioned downstream from the sprayers 16*b* in a running direction of the special cable 23. The marking dies 16*c* can contact the outer surface 9*a* of the special cable 23 to coat a part of the outer surface 9*a* with a paint or a coloring liquid having a color R which is different from the second color Q and the first color P. The color R is one of the second colors described in this specification.

Thus configured third coloring unit 16 can coat the perimeter of the outer surface 9*a* of the special cable 23, which has been colored in the first color P (shown by parallel diagonal lines in FIG. 5*b*), with the second color Q (shown by parallel diagonal lines in FIG. 5*c*) by means of the sprayers 16*b*. Furthermore, the 16*b* coats a part of the outer surface 9*a* with the second color R different from the colors P and Q, so that the coloring unit 16 defines a stripe pattern shown in FIG. 5*c* on the outer surface 9*a* of the special cable 23 with the second colors Q and R.

Figure 6A:
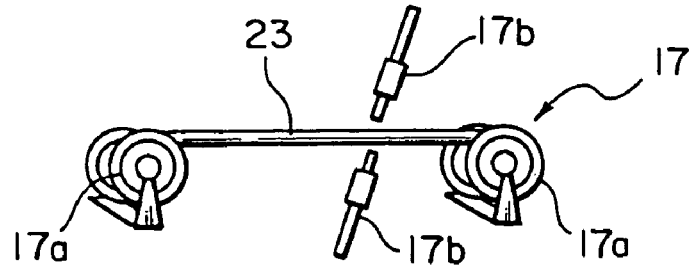
FIG. 6 is an explanatory illustration showing a fourth coloring unit of the wiring harness fabricating apparatus of FIG. 1, FIG. 6*a* being an explanatory illustration showing the fourth coloring unit, FIG. 6*b* being a perspective view showing an electrical cable before the cable is colored by the fourth coloring unit, FIG. 6*c* being a perspective view showing an electrical cable after the cable is colored by the fourth coloring unit.
Figure 6B:
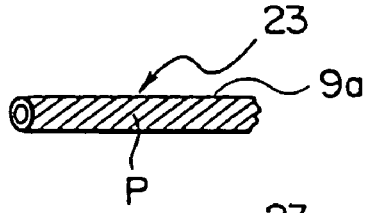
Figure 6C:
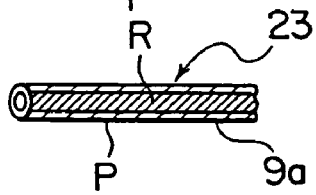

The fourth coloring unit 17 of FIG. 6 has a pair of rollers 17*a* and a plurality of marking dies 17*b* as shown in FIG. 6*a*. The pair of rollers 17*a* are spaced from each other, between which the special cable 23 runs in a longitudinal direction of the special cable 23.

There are provided a pair of the marking dies 17*b* in an example shown in FIG. 6. The marking dies 17*b* can contact the outer surface 9*a* of the special cable 23 to coat a part of the outer surface 9*a* with a paint or a coloring liquid having a second color R which is different from the first color P.

Thus configured fourth coloring unit 17 can coat a part of the outer surface 9*a* of the special cable 23, which has been colored in the first color P (shown by parallel diagonal lines in FIG. 6*b*), with the second color R (shown by parallel diagonal lines in FIG. 5*c*) by means of the marking dies 17*b*. Accordingly, the coloring unit 17 defines a stripe pattern shown in FIG. 6*c* on the outer surface 9*a* of the special cable 23 with the second R.

Figure 7A:
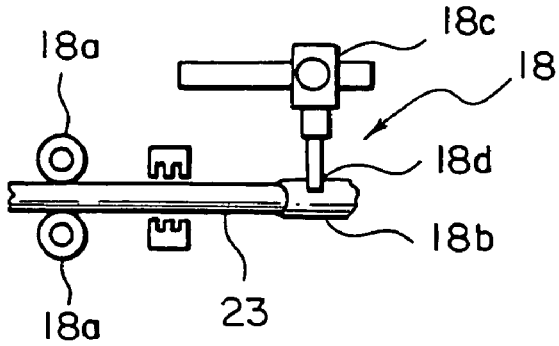
FIG. 7 is an explanatory illustration showing a fifth coloring unit of the wiring harness fabricating apparatus of FIG. 1, FIG. 7*a* being an explanatory illustration showing the fifth coloring unit, FIG. 7*b* being a perspective view showing an electrical cable colored by the fifth coloring unit.

The fifth coloring unit 18 of FIG. 7 has a pair of feed rollers 18*a*, a tube 18*b*, and a coloring device 18*c* as shown in FIG. 7*a*. The pair of feed rollers 18*a* pinch the special cable 23 to feed the special cable 23 therebetween.

The tube 18*b* is a circular tube in which an end of the special cable 23 can run through the tube. The tube 18*b* is formed with a through hole 18*d*. The coloring device 18*c* coats a part of the outer surface 9*a* of the special cable 23 via the through hole 18*d* with a paint or a coloring liquid having a second color S (shown by parallel diagonal lines in FIG. 7*b*) which is different from the first color P.

Figure 7B:
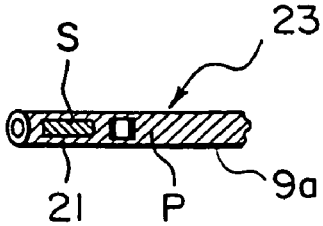

Thus configured fifth coloring unit 18 can coat a part of the outer surface 9*a* of the special cable 23, which has been colored in the first color P (shown by parallel diagonal lines in FIG. 7*b*), with the second color S by means of the coloring device 18*c*. Accordingly, the coloring unit 18 defines a mark 21 on a part of the outer surface 9*a* of the special cable 23 with the second S as shown in FIG. 7*b*.

Figure 8A:
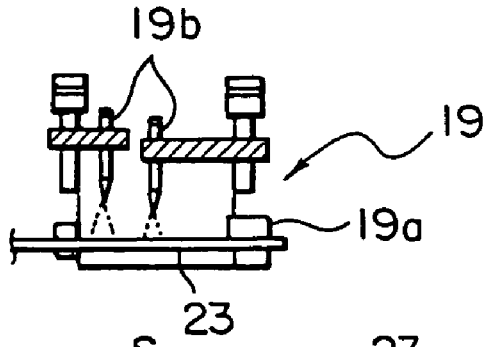
FIG. 8 is an explanatory illustration showing a sixth coloring unit of the wiring harness fabricating apparatus of FIG. 1, FIG. 8*a* being an explanatory illustration showing the sixth coloring unit, FIG. 8*b* being a perspective view showing an electrical cable colored by the sixth coloring unit.
Figure 8B:
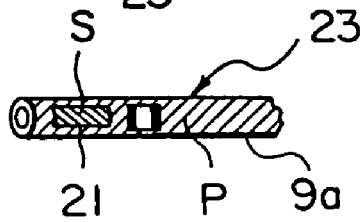

The sixth coloring unit 19 of FIG. 8 has a cable clamping device 19*a* and a sprayer 19*b* as shown in FIG. 8*a*. The cable clamping device 19*a* clamps (secure) particularly an end of the special cable 23. The sprayer 19*b* sprays a paint or a coloring liquid against a part of an end of the outer surface 9*a* of the special cable 23. The sprayer 19*b* colors the part of the outer surface 9*a* with a second color S (shown by parallel diagonal lines in FIG. 8*b*) which is different from the first color P.

Thus configured sixth coloring unit 19 can coat the part of the outer surface 9*a* of the special cable 23, which has been colored in the first color P (shown by parallel diagonal lines in FIG. 8*b*), with the second color S by means of the sprayer 19*b*. Accordingly, the coloring unit 19 defines a mark 21 on a part of the outer surface 9*a* of the special cable 23 with the second S as shown in FIG. 8*b*.

Figure 9A:
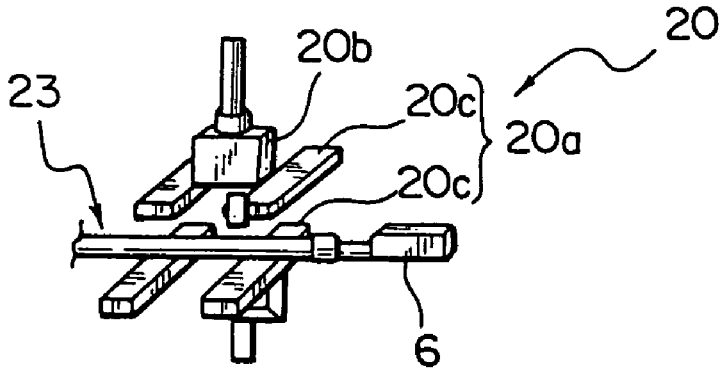
FIG. 9 is an explanatory illustration showing a seventh coloring unit of the wiring harness fabricating apparatus of FIG. 1, FIG. 9*a* being an explanatory illustration showing the seventh coloring unit, FIG. 9*b* being a perspective view showing an electrical cable colored by the seventh coloring unit.

The seventh coloring unit 20 of FIG. 9 has a cable clamping device 20*a* and a stamp 20*b* as shown in FIG. 9*a*. The cable clamping device 20*a* has pinching pieces 20*c* moving close to each other. A pair of the pinching pieces 20*c* pinches the special cable 23, particularly an end portion thereof therebetween. The cable clamping device 20*a* clamps (secure) the end portion of the special cable 23.

The stamp 20*b* can move up to the end portion of the special cable 23 when the special cable 23 is pinched between the pinching pieces 20*c* moving close to each other. The stamp 20*b* contacts the end portion of the special cable 23 and coats a part of the outer surface 9*a* with a paint or a coloring liquid. The stamp 20*b* colors the part of the outer surface 9*a* with a second color S (shown by parallel diagonal lines in FIG. 9*b*) which is different from the first color P.

Figure 9B:
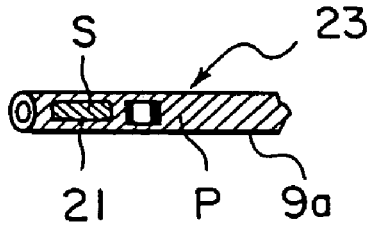

Thus configured seventh coloring unit 20 can coat the part of the outer surface 9*a* of the special cable 23, which has been colored in the first color P (shown by parallel diagonal lines in FIG. 9*b*), with the second color S by means of the stamp 20*b*. Accordingly, the coloring unit 20 defines a mark 21 on a part of the outer surface 9*a* of the special cable 23 with the second color S as shown in FIG. 9*b*.

For producing the wiring harness 2 by means of the wiring harness fabricating apparatus 1, first, step S1 of FIG. 2 uses the coloring unit 22 to color at least a part of an outer surface 9*a* of a special cable 23 stored in the electrical cable storehouse 24, which has been colored in a first rarely used color P, with a second frequently used color Q, R, or S. Then, step S2 is carried out.

In step 2, a colored cable 3 is transferred from the electrical cable fabricating apparatus 10 to the cutting unit 11, and a special cable 23 having a second color Q, R, or S is transferred from the coloring unit 22 to the cutting unit 11. The cutting unit 11 cuts the cable 3 and the special cable 23 each in a desired length and removes the sheath 9 of the cut cable 3 and the special cable 23 at an end of each cable to fit a terminal piece 6 to the exposed end of the cable 3 or the special cable 23. Then, step 3 is carried out.

In Step 3, the cable 3 and the special cable 23 are transferred from the cutting unit 11 to the jointing unit 12. The jointing unit 12 removes the sheath 9 at the jointing portion of the cable 3 or the special cable 23 and connects the cables 3 or the special cables 23 with each other by means of the jointing piece 5. Then, step S4 is carried out.

In Step 4, the cable 3 and the special cable 23 are transferred from the jointing unit 12 to the casing unit 13. The casing unit 13 inserts the terminal piece 6, which have been fitted at one end of the cable 3 or 23, into a connector housing 7. The casing unit 13 secures the terminal piece 6 to the connector housing 7. Thus, the wiring harness fabricating apparatus 1 assembles the wiring harness 2.

Next, referring to FIG. 10, an experimental result obtained by the inventors of the present invention will be discussed, in which an outer surface 9*a* of a special cable 23 having a first color P was coated with a second color Q, R, or S. The first color P of the special cable 23 was selected to be yellow. Furthermore, a plurality of the special cables 23 having the first color P but different form each other in brightness were coated with various kinds of the second color Q, R, or S. The second color Q, R, or S which could cover the first color was determined to be acceptable as a second color.

Figure 10:
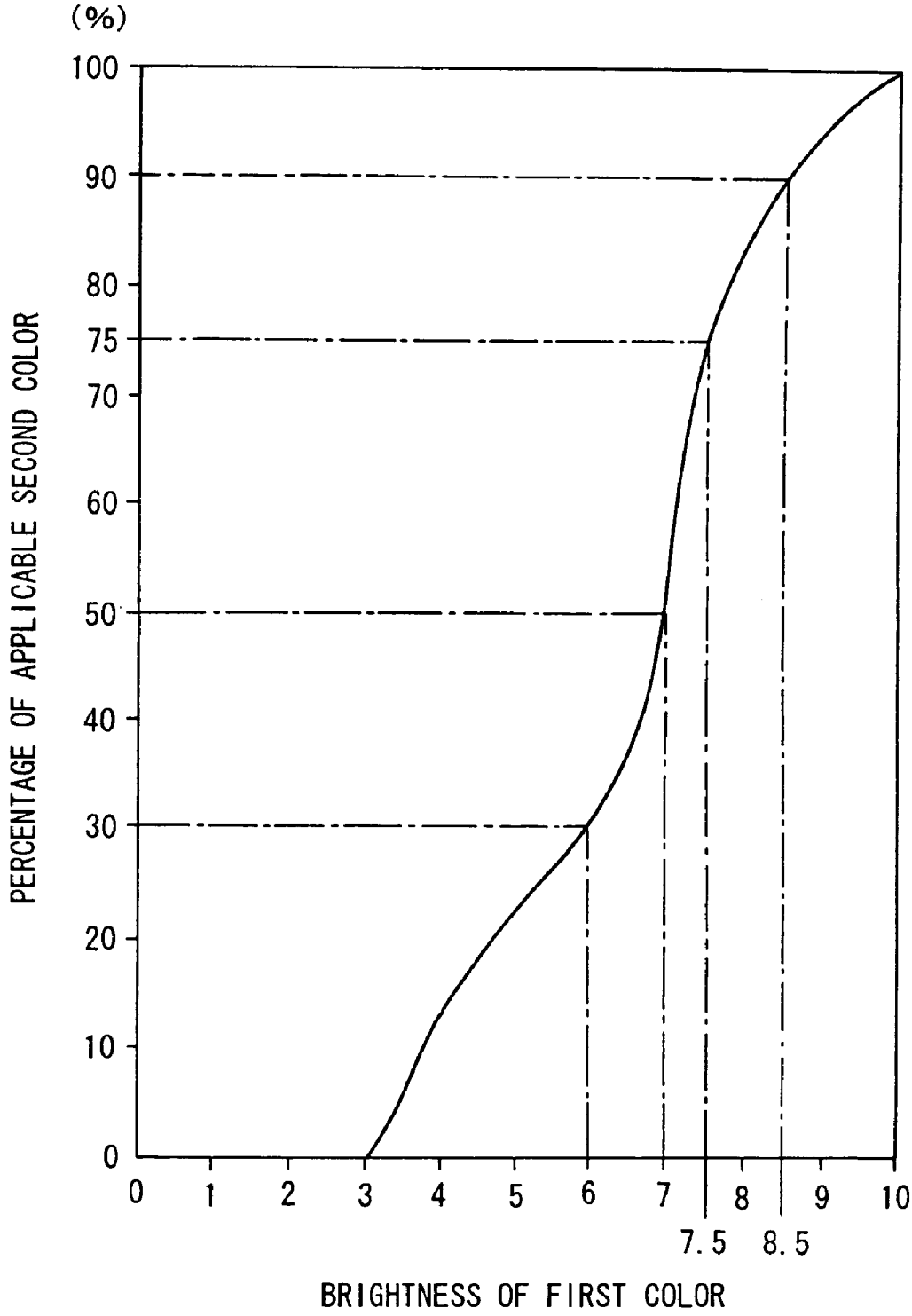
FIG. 10 is a graph showing a result which is obtained by coating an outer surface of a cable sheath with a second color by the wiring harness fabricating apparatus of FIG. 1, the outer surface having been coated with a first color different from the second color in brightness.

In FIG. 10, a lateral coordinate indicates a brightness grade of the first color P, and a larger coordinate shows a brighter (lighter) grade of the first color. In FIG. 10, a vertical coordinate indicates a percentage of the second color Q, R, or S which is acceptable as a second color. That is, when all the second colors Q, R, and S can be used on the outer surface 9*a* of the special cable 23 over the first color, the value of the vertical coordinate is 100 percent.

From FIG. 10, it is found that the first color P less than 3 in a brightness scale provides 0 (zero) percent of acceptable second colors Q, R, and S. That is, when the first color P is less than 3 in the brightness scale, none of the second colors Q, R, and S are acceptable. When the first color P is not less than 6 in the brightness scale, a ratio of the second colors Q, R, and S acceptably used is not less than 30 percent. That is, when the first color P is not less than 6 in the brightness scale, not less than 30 percent of the second colors Q, R, and S can be used for coating the outer surface 9*a* of the cable 3 applied to the wiring harness 2.

Furthermore, when the first color P is not less than 7 in the brightness scale, a ratio of the second colors Q, R, and S acceptably used is not less than 50 percent. That is, when the first color P is not less than 7 in the brightness scale, not less than 50 percent of the second colors Q, R, and S can be used for coating the outer surface 9*a* of the cable 3 applied to the wiring harness 2. When the first color P is not less than 7.5 in the brightness scale, a ratio of the second colors Q, R, and S acceptably used is not less than 75 percent. That is, when the first color P is not less than 7.5 in the brightness scale, not less than 75 percent of the second colors Q, R, and S can be used for coating the outer surface 9*a* of the cable 3 applied to the wiring harness 2.

Furthermore, when the first color P is not less than 8.5 in the brightness scale, a ratio of the second colors Q, R, and S acceptably used is not less than 90 percent. That is, when the first color P is not less than 8.5 in the brightness scale, not less than 90 percent of the second colors Q, R, and S can be used for coating the outer surface 9*a* of the cable 3 applied to the wiring harness 2.

In the embodiment, the outer surface 9*a* of the sheath 9 of the special cable 23 having a first rarely used color P is colored with a second frequently used color R, Q, or S to reduce a stock of the special cables 23, so that the special cables 23 will be used for the wiring harness 2 since the second color R, Q, or S is a frequently used color.

The special cable 23 may not be stocked for a long time since the special cable 23 is changed in color from a first rarely used color P to a frequently used color R, Q, or S, reducing the number of the stock of the special cables 23 and the cables 3. This also reduces a space for stocking the cables 3 and special cables 23 in a producing factory of the wiring harness 2.

Furthermore, the first color P is the same as the second colors Q, R, and S in hue and is higher than the second colors Q, R, and S, in the brightness scale. Thus, the second colors Q, R, and S can surely cover the first color P, so that the special cable 23 is surely used for the wiring harness 2. In the present invention, the first color P may not be limited in rarely used colors, and the second color R, Q, or S may not be limited in frequently used colors.

In the embodiment, when the first color P is not less than 6 in the brightness scale, not less than 30 percent of the second colors Q, R, and S can be used for coating the outer surface 9*a* of the cable 3 applied to the wiring harness 2 since not less than 30 percent of the second colors Q, R, and S can cover the first color P. Thus, the special cable 23 is surely used for the wiring harness 2, surely reducing the number of the special cables 23 stocked for a long time.

In the embodiment, the first color P may be not less than 7 in the brightness scale. Thereby, not less than 50 percent of the second colors Q, R, and S can be used for coating the outer surface 9*a* of the cable 3 applied to the wiring harness 2, since not less than 50 percent of the second colors Q, R, and S can cover the first color P. Thus, the special cable 23 is surely used for the wiring harness 2, surely reducing the stock number of the special cables 23 stocked for a long time.

In the embodiment, the first color P may be not less than 7.5 in the brightness scale. Thereby, not less than 75 percent of the second colors Q, R, and S can be used for coating the outer surface 9*a* of the cable 3 applied to the wiring harness 2, since not less than 75 percent of the second colors Q, R, and S can cover the first color P. Thus, the special cable 23 is surely used for the wiring harness 2, surely reducing the stock number of the special cables 23 stocked for a long time.

In the embodiment, the first color P may be not less than 8.5 in the brightness scale. Thereby, not less than 90 percent of the second colors Q, R, and S can be used for coating the outer surface 9*a* of the cable 3 applied to the wiring harness 2, since not less than 90 percent of the second colors Q, R, and S can cover the first color P. Thus, the special cable 23 is surely used for the wiring harness 2, surely reducing the stock number of the special cables 23 stocked for a long time.

Note that a color or a mark 21 provided on the cables 3 and special cables 23 does not indicate an assembling step but serves to recognize a kind of the cables 3 and 23 or a system in which the cables are applied. Furthermore, in the invention, the special cable 23 having a first color is coated with a second color Q, R, or S, but a sheath 9 having no color is not coated with a second color Q, R, or S.

In the wiring harness fabricating apparatus, the outer surface 9*a* of the special cable 23 is colored with a second color Q, R, or S before the cutting unit 11 cuts the cable 3 and the special cable 23 in a desired length to remove a part of the 9. However, in the invention, it is easily appreciated that the special cable 23 may be provided with a second color by the first to seventh coloring units 14 to 20 before or after the steps of cutting the cables 3 and 23, removing the 9, fitting the terminal piece 6, and inserting the terminal piece 6 into the connector housing 7.

The aforementioned embodiment relates to the wiring harness 2 arranged in a car. However, it is easily appreciated that the wiring harness 2 provided by the fabricating method may be applied to various types of electronic instruments and electric machines such as a portable computer.

In the invention, the special cable 23 may be coated with a second color Q, R, or S by means of dipping, spraying, jetting, printing, transcribing, etc. The coloring liquid or paint may be an acrylic paint, an ink including a dye or a pigment, a UV ink, etc.

The aforementioned embodiment also enables an electrical cable reuse method which is applied for assembling a wiring harness consisting of a plurality of electrical cables and connectors fitted to the cables. The method is characterized in that a special electrical cable used for a special application has a sheath of which an outer surface having a first color, and the outer surface is covered by a second color different from the first color before assembling the wiring harness.

INDUSTRIAL AVAILABILITY OF THE INVENTION

As mentioned above, in the present invention, the sheath outer surface which has been coated with a first color is coated with a second color different from the first color. The second color is selected to be a frequently used color, so that the special electrical cable may not be stocked for a long time, reducing the number of stocked special electrical cables. This also reduces a space for stocking the electrical cables in a producing factory of the wiring harness.

In the present invention, the first color is brighter than the second color, so that the second color can surely cover the first color. The second color surely coats the outer surface having the first color, and the special electrical cable is surely used in a wiring harness. This reduces the number of the electrical cables stocked for a long time.

In the present invention, the first color not less than 6 and not more than 10 in the brightness scale can surely cover the first color so that the second color is surely coated on the outer surface which has been coated with the first color. The special electrical cable is surely used in a wiring harness. This reduces the number of the electrical cables stocked for a long time.

In the present invention, the first color not less than 7 and not more than 10 in the brightness scale can surely cover the first color so that the second color is surely coated on the outer surface which has been coated with the first color. The special electrical cable is surely used in a wiring harness. This reduces the number of the electrical cables stocked for a long time.

In the present invention, the first color not less than 7.5 and not more than 10 in the brightness scale can surely cover the first color so that the second color is surely coated on the outer surface which has been coated with the first color. The special electrical cable is surely used in a wiring harness. This reduces the number of the electrical cables stocked for a long time.

In the present invention, the first color not less than 8.5 and not more than 10 in the brightness scale can surely cover the first color so that the second color is surely coated on the outer surface which has been coated with the first color. The special electrical cable is surely used in a wiring harness. This reduces the number of the electrical cables stocked for a long time.

In the present invention, since the first color is the same as the second color in hue, the second color surely coats the outer surface which has been coated with the first color. The special electrical cable is surely used in a wiring harness. This reduces the number of the electrical cables stocked for a long time.

What is claimed is:

1. An electrical cable reuse method applied to a wiring harness consisting of a plurality of electrical cables, characterized in that a special electrical cable has a sheath of which an outer surface is colored in a first color, that is not less than 6 and not more than 10 in the brightness scale and the outer surface of said sheath of said special electrical cable is covered with a coloring material of a second color different from the first color to be used for assembling the wiring harness and the first color is higher than the second color in the brightness scale.

2. A method according to claim 1, characterized in that the first color is not less than 5 and not more than 10 in the brightness scale.

3. A method according to claim 1, characterized in that the first color is not less than 7.5 and not more than 10 in the brightness scale.

4. A method according to claim 1, characterized in that the first color is not less than 8.5 and not more than 10 in the brightness scale.

5. A method according to claim 1, characterized in that the first color is the same as the second color in hue.

* * * * *